US011719053B2

(12) United States Patent
Roy

(10) Patent No.: US 11,719,053 B2
(45) Date of Patent: Aug. 8, 2023

(54) METHOD OF USING A ROD POSITIONING DEVICE

(71) Applicant: DR FABRICATION INC., Val d'Or (CA)

(72) Inventor: Daniel Roy, Val d'Or (CA)

(73) Assignee: DR FABRICATION INC., Val-d'Or (CA)

( * ) Notice: Subject to any disclaimer, the term of this patent is extended or adjusted under 35 U.S.C. 154(b) by 13 days.

(21) Appl. No.: 17/478,419

(22) Filed: Sep. 17, 2021

(65) Prior Publication Data

US 2022/0003052 A1 Jan. 6, 2022

Related U.S. Application Data

(63) Continuation of application No. 16/532,030, filed on Aug. 5, 2019, now Pat. No. 11,125,029, which is a continuation of application No. 15/593,814, filed on May 12, 2017, now Pat. No. 10,400,525.

(60) Provisional application No. 62/336,309, filed on May 13, 2016.

(51) Int. Cl.

| | |
|---|---|
| ***E21B 19/14*** | (2006.01) |
| ***E21B 19/16*** | (2006.01) |
| ***E21B 19/24*** | (2006.01) |
| ***E21B 7/02*** | (2006.01) |

(52) U.S. Cl.

CPC ..... *E21B 19/14* (2013.01); *E21B 19/161* (2013.01); *E21B 19/24* (2013.01); *E21B 7/025* (2013.01)

(58) Field of Classification Search

CPC ..... E21B 19/14; E21B 19/161; E21B 19/24

See application file for complete search history.

(56) References Cited

U.S. PATENT DOCUMENTS 4,213,345 A * 7/1980 Dufour ..... G01N 29/2493 73/639
4,217,782 A * 8/1980 Pont ..... G01N 29/2493 73/639
5,686,668 A * 11/1997 McLean ..... G01N 29/26 73/639
5,762,150 A * 6/1998 Cheng ..... E21B 19/14 175/85
5,791,822 A * 8/1998 Edmondson ..... E21D 20/006 405/303

(Continued)

*Primary Examiner* — Aaron L Lembo
(74) *Attorney, Agent, or Firm* — Benoit & Cote Inc.; Mathieu Audet; Charles-Andre Caron

(57) ABSTRACT

A rod positioning device for aligning a drilling rod with a rod string having complementary mating threads, comprising a base, an arm mounted to the base about a first rotation axis, and a rod-gripping device mounted on the arm. The arm is for displacement about the first rotation axis between a rod loading position and a rod alignment position. The rod-gripping device is for operating between a rod-gripping configuration and a rod-releasing configuration. The rod-gripping device comprises jaws for gripping the drilling rod while the rod-gripping device is in the rod-gripping configuration and the arm is in the rod loading position, and guiding elements mounted on the jaws, the guiding elements aligning the drilling rod with the rod string and enabling longitudinal displacement of the drilling rod to contact the rod string. A method of use is further provided.

20 Claims, 13 Drawing Sheets

(56) References Cited

U.S. PATENT DOCUMENTS

| | | | | |
|---|---|---|---|---|
| 6,550,128 | B1 * | 4/2003 | Lorenz | E21B 19/20 29/559 |
| 7,114,235 | B2 * | 10/2006 | Jansch | E21B 19/24 29/709 |
| 7,347,285 | B2 * | 3/2008 | Hamner | E21B 19/14 175/203 |
| 7,509,722 | B2 * | 3/2009 | Shahin | E21B 19/20 166/85.1 |
| 8,186,925 | B2 * | 5/2012 | Littlely | E21B 19/155 414/22.55 |
| 8,281,877 | B2 * | 10/2012 | Shahin | E21B 19/161 166/85.1 |
| 8,550,174 | B1 * | 10/2013 | Orgeron | E21B 19/24 166/380 |
| 8,747,045 | B2 * | 6/2014 | Belik | E21B 19/24 414/745.2 |
| 8,910,719 | B2 * | 12/2014 | Kockeis | E21B 19/15 166/85.1 |
| 9,428,971 | B2 * | 8/2016 | Pyörny | E21B 19/16 |
| 9,650,849 | B2 * | 5/2017 | Jelgert | E21B 19/15 |
| 9,926,752 | B2 * | 3/2018 | Adams | E21B 19/168 |
| 10,100,592 | B2 * | 10/2018 | Wase | E21B 19/08 |
| 10,145,188 | B2 * | 12/2018 | Smith | E21B 19/14 |
| 2003/0221871 | A1 * | 12/2003 | Hamilton | E21B 19/14 175/85 |
| 2005/0133228 | A1 * | 6/2005 | Shampine | E21B 19/22 166/77.2 |
| 2009/0238663 | A1 * | 9/2009 | Littlely | E21B 19/155 414/800 |
| 2016/0115750 | A1 * | 4/2016 | Jelgert | E21B 7/02 166/77.51 |
| 2017/0328147 | A1 * | 11/2017 | Roy | E21B 19/161 |

* cited by examiner

METHOD OF USING A ROD POSITIONING DEVICE

CROSS-REFERENCE TO RELATED APPLICATION

This application is a continuation of patent application U.S. Ser. No. 16/532,030 filed Aug. 5, 2019, which is a continuation of patent application U.S. Ser. No. 15/593,814 filed May 12, 2017, which claims priority of U.S. provisional patent application 62/336,309 filed May 13, 2016, the specification of which is hereby incorporated herein by reference in its entirety.

BACKGROUND

(a) Field

The subject matter disclosed generally relates to mining equipment and, more particularly, to exploration drilling equipment.

(b) Related Prior Art

In exploration drilling, the average length of a drill hole obtained from the use of a rod string may typically be about 900 m. The rod string is typically composed of a plurality of drilling rods, which, depending on configuration, typically weigh about 11-20 kg each and measure about 2-3 m in length. The drilling rods are typically interconnected by a threaded connection.

Moreover, in many applications, also depending on rock type, tool type and drilling speed, it is a common necessity to exchange the drilling bit or other tool parts many times during the drilling process, for instance an average once every 300 m of drilling. Changing tools may be associated with retrieving the entire rod string from the hole, changing the lowermost portion of the rod string and then reinserting the entire rod string, after which drilling may continue. In practice, and depending on rock conditions, 10 to 20 retrieval operations per drill hole is not uncommon.

Needless to say, a very large number of drilling rods will need to be handled, including picking them from a transport carrier, inserting them into the drill, aligning them with the rod string, joining them to the rod string, fastening them, releasing them and replacing them at the transport carrier.

In reality, this may mean that an operator has to carry/lift an 11 to 20 kg drilling rod about 1200 times to or from the rig for each hole. With an estimated average number of holes drilled per rig of 35 holes/year, this adds up to carrying 2100 to 3820 kg of drilling rods per day for an operator (based on 220 working days per year).

Furthermore, with that number of manipulated drilling rods, there are substantial financial advantages in any solution that facilitates the alignment of drilling rods with the rod string.

There is therefore a need for improvement in devices and methods involved in carrying drilling rods and aligning them with a rod string.

SUMMARY

One general aspect includes a rod positioning device for aligning a drilling rod with a rod string having complementary mating threads, including: —a base; —an arm mounted to the base about a first rotation axis, the arm being adapted for displacement about the first rotation axis between a rod loading position and a rod alignment position; and —a rod-gripping device mounted on the arm and adapted for operating between a rod-gripping configuration and a rod-releasing configuration, the rod-gripping device including: The rod also includes—jaws for gripping the drilling rod while the rod-gripping device is in the rod-gripping configuration and the arm is in the rod loading position. The rod also includes—guiding elements mounted on the jaws, the guiding elements align the drilling rod with the rod string and enable longitudinal displacement of the drilling rod upon application of a longitudinal force on the drilling rod to contact the rod string while the rod-gripping device is in the rod-releasing configuration and while the arm is in the rod alignment position. Other embodiments of this aspect include corresponding computer systems, apparatus, and computer programs recorded on one or more computer storage devices, each configured to perform the actions of the methods.

Implementations may include one or more of the following features. The rod positioning device where the guiding elements include rollers pivoting about at least a roller pivotal axis perpendicular to an axis of the drilling rod. The rod positioning device where the guiding elements further enable rotational displacement of the drilling rod upon application of a rotational force on the drilling rod to join the drilling rod to the rod string. The rod positioning device further including a jack controlling a transition between the rod-gripping configuration and the rod-releasing configuration, the jack having a first end attached to the arm and a second end attached to one of the jaws, namely a pivoting jaw. The rod positioning device where a jaw opposite the pivoting jaw is fixedly mounted to the arm. The rod positioning device where the arm has a shape providing clearance between the first rotation axis and an axis of the drilling rod. The rod positioning device where the rod-gripping device further includes a rod driving element oriented at an acute angle relative to an axis of the drilling rod for longitudinally displacing and rotating the drilling rod to put into contact and to join the drilling rod to the rod string through the complementary mating threads. The rod positioning device where the guiding elements are multi-directional low-resistance guiding elements. The rod positioning device where the guiding elements includes drop-in cast ball bearings. The rod positioning device where the rod-gripping device includes a first jaw and a second jaw, where the rod driving element is mounted to the first jaw. The rod positioning device where the guiding elements further include a mounting component mounted on the first jaw, where the mounting component is biased toward the second jaw. The rod positioning device further including a base, where the arm is movably mounted to the base. The rod positioning device where the rod-gripping device further includes a pitch controlling device adapted to set the acute angle between a first angle and a second angle distinct from the first angle. The rod positioning device where the rod driving element includes a rod driving wheel contacting the drilling rod at the acute angle. The rod positioning device where the rod driving element includes a motor mounted to the rod gripping device and a driving wheel mounted to the motor, where the driving wheel drives the drilling rod in a longitudinal and rotational movement according to the acute angle. The rod positioning device further including a mast and a rod support, where the arm and the rod support are mounted to the mast distal from each other, and where the drilling rod is disposed on the rod support and the rod-gripping device. The rod positioning device where the guiding elements are multi-directional low-resistance guiding elements. The rod positioning device where the rod-gripping device further includes a pitch controlling device adapted to set the acute angle between a first angle and a second angle distinct from the first angle. Implementations of the described techniques may include hardware, a method or process, or computer software on a computer-accessible medium.

One general aspect includes a rod positioning device for joining a drilling rod to a rod string having complementary mating threads, including: —an arm; and —a rod-gripping device mounted to the arm and defining a gripping axis, the rod-gripping device including: —guiding elements for alignment of the drilling rod to the gripping axis; and —a rod driving element oriented at an acute angle relative to the gripping axis for longitudinally displacing and rotating the drilling rod to put into contact and to join the drilling rod to the rod string through the complementary mating threads. Other embodiments of this aspect include corresponding computer systems, apparatus, and computer programs recorded on one or more computer storage devices, each configured to perform the actions of the methods.

Implementations may include one or more of the following features. The rod positioning device where the guiding elements are multi-directional low-resistance guiding elements. The rod positioning device where the guiding elements includes drop-in cast ball bearings. The rod positioning device where the rod-gripping device includes a first jaw and a second jaw, where the rod driving element is mounted to the first jaw. The rod positioning device where the guiding elements further include a mounting component mounted on the first jaw, where the mounting component is biased toward the second jaw. The rod positioning device further including a base, where the arm is movably mounted to the base. The rod positioning device where the rod-gripping device further includes a pitch controlling device adapted to set the acute angle between a first angle and a second angle distinct from the first angle. The rod positioning device where the rod driving element includes a rod driving wheel contacting the drilling rod at the acute angle. The rod positioning device where the rod driving element includes a motor mounted to the rod gripping device and a driving wheel mounted to the motor, where the driving wheel drives the drilling rod in a longitudinal and rotational movement according to the acute angle. The rod positioning device further including a mast and a rod support, where the arm and the rod support are mounted to the mast distal from each other, and where the drilling rod is disposed on the rod support and the rod-gripping device. The rod positioning device where the guiding elements are multi-directional low-resistance guiding elements. The rod positioning device where the rod-gripping device further includes a pitch controlling device adapted to set the acute angle between a first angle and a second angle distinct from the first angle. Implementations of the described techniques may include hardware, a method or process, or computer software on a computer-accessible medium.

One general aspect includes a rod positioning device for joining a drilling rod to a rod string having complementary mating threads, the drilling rod and the rod string being aligned along a string axis while being joined, the rod positioning device including: —an arm; and —a rod-gripping device mounted to the arm and defining a gripping axis, the rod-gripping device including: —jaws having an first end and a second end relative to the gripping axis. The rod also includes—guiding elements mounted to the jaws distant from each other along the gripping axis, the guiding elements contacting the drilling rod for alignment of the drilling rod with the gripping axis; and —a rod driving element oriented at an acute angle relative to the string axis for longitudinally displacing and rotating the drilling rod to put into contact and to join the drilling rod to the rod string through the complementary mating threads. Other embodiments of this aspect include corresponding computer systems, apparatus, and computer programs recorded on one or more computer storage devices, each configured to perform the actions of the methods.

Implementations may include one or more of the following features. The rod positioning device where the guiding elements are multi-directional low-resistance guiding elements. The rod positioning device where the rod-gripping device further includes a pitch controlling device adapted to set the acute angle between a first angle and a second angle distinct from the first angle. Implementations of the described techniques may include hardware, a method or process, or computer software on a computer-accessible medium.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
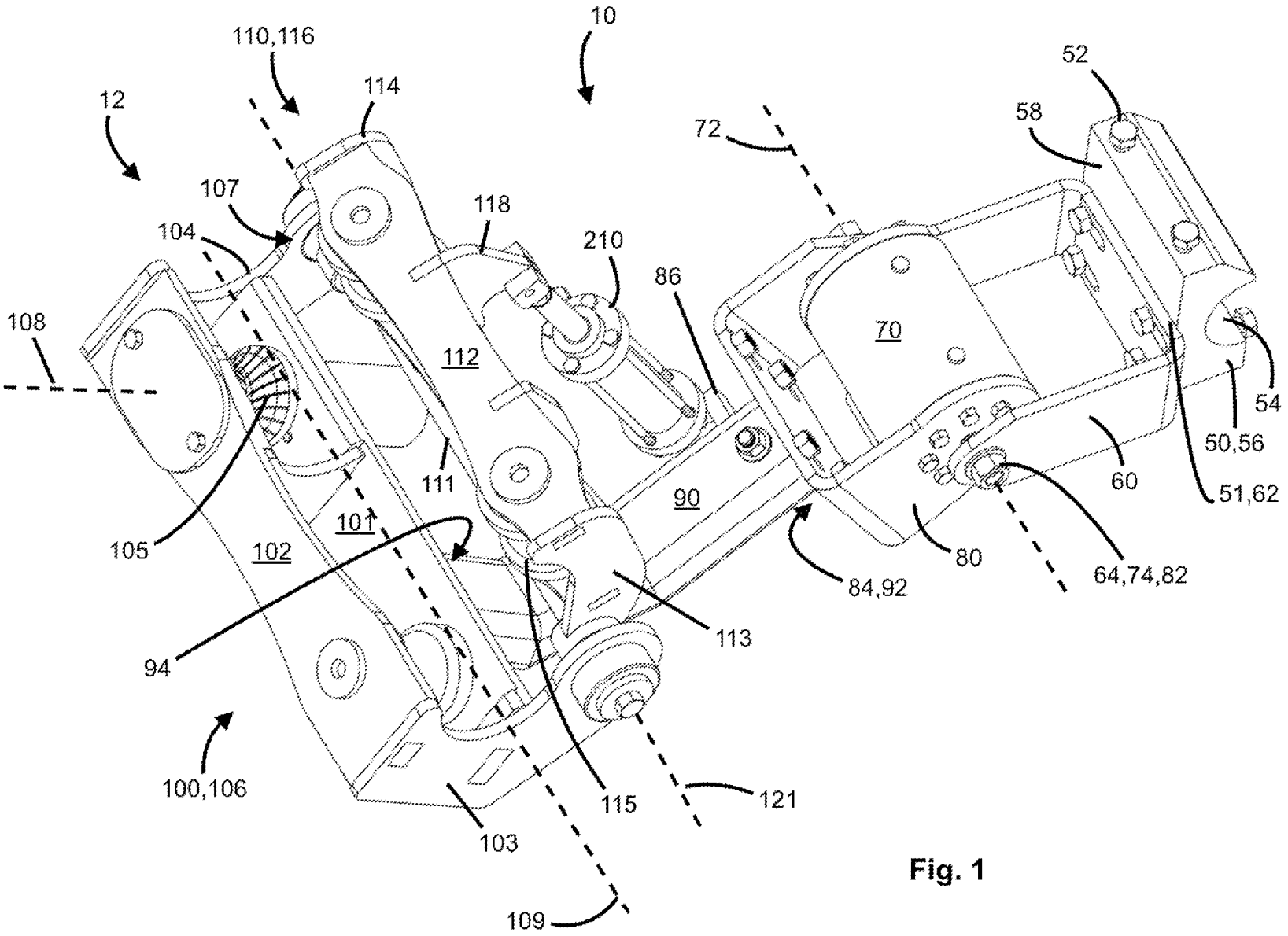
FIG. 1 is a perspective view of a rod positioning device in accordance with an embodiment.

Referring now to the drawings, and more particularly to FIG. 1, there is disclosed a rod positioning device 10 for aligning drilling rods. The rod positioning device 10 is more particularly used for carrying/handling drilling rods 14 (see FIGS. 3-7) from an inventory condition into an aligned condition wherein the aligned drilling rod 14 may be joined to an in-use drilling rod 16 (see FIGS. 3-7) forming part of a rod string.

Still referring to FIG. 1, the rod positioning device 10 comprises a base 50 to be attached to a drilling vehicle or another kind of rod string handler 200 (see FIGS. 2 to 8). The rod positioning device 10 further comprises a first arm portion 60, a hydraulic rotary cylinder 70, a second arm portion 80, a still jaw arm 90, a still jaw portion 100, a mobile jaw portion 110 opposed to the still jaw portion 100, and a hydraulic power jack 120.

The base 50 comprises a series of bolts 52 for fastening the base 50 to a portion of the rod string handler 200.

The next portion of the present description will present an embodiment in which the rod positioning device 10 is attached to a rod string handler 200, but one must understand that alternatives of rod string handling devices are possible, as are other alternative devices, vehicles and structures suitable for mounting such a rod positioning device 10.

Back to the rod positioning device 10, the base 50 features at its mounting end a semi-circular surface 54 for the base 50 to interface with a rod-shaped component of rod string handler 200. However, alternative embodiments are available while not illustrated including having only the base left side 56 and the base right side 58 of the base 50 having a semi-circular shape and therefore interfacing with a portion of the rod string handler 200. Another alternative embodiment consists in having the base 50 interfacing with one or more surface(s), flat or otherwise, of a portion of the rod string handler 200; the base 50 being potentially fastened with bolts, clips, or an alternative fastening means to solidly attach, permanently or temporarily, the base 50 to the rod string handler 200.

On its opposite side 51, the base 50 is attached to the first end 62 of the first arm portion 60.

The first arm portion 60 is attached at its first end 62 to the base 50 and attached pivotally to the second arm portion 80 at its second end 64. The pivotal attachment between the first arm portion 60 and the second arm portion 80 is about an arm joint 74 having a first rotation axis 72 about which the second arm portion 80 rotates.

Mounted with respect to the first rotation axis 72 is the hydraulic rotary cylinder 70 that drives the rotation of the second arm portion 80 for displacement in a vertical plane. The hydraulic rotary cylinder 70 is fed with hydraulic fluid by a motor (not shown) mounted on the rod string handler 200 (not illustrated in FIG. 1) through hydraulic hoses (not shown).

The hydraulic rotary cylinder 70 is configured to rotate the second arm portion 80 in a clockwise direction or in a counter clockwise direction with respect to the first rotation axis 72 to place the rod positioning device 10 in a low or rod-gripping configuration, to receive a drilling rod 14, and to place the rod positioning device 10 in an elevated or rod-releasing configuration, wherein the still jaw arm 90 is in a rod alignment position, and wherein a drilling rod 14 handled by the rod positioning device 10 would be aligned with an in-use drilling rod 16.

Mounted to the first arm portion 60, the second arm portion 80 is attached at a first end 82 to the first arm portion 60 and attached (fastened or welded) at a second end 84 to the still jaw arm 90. The second arm portion 80 features an arm lug 86 on which is attached the hydraulic power jack 120 controlling the opening of the rod-gripping device 12 as explained further below.

Figure 6:
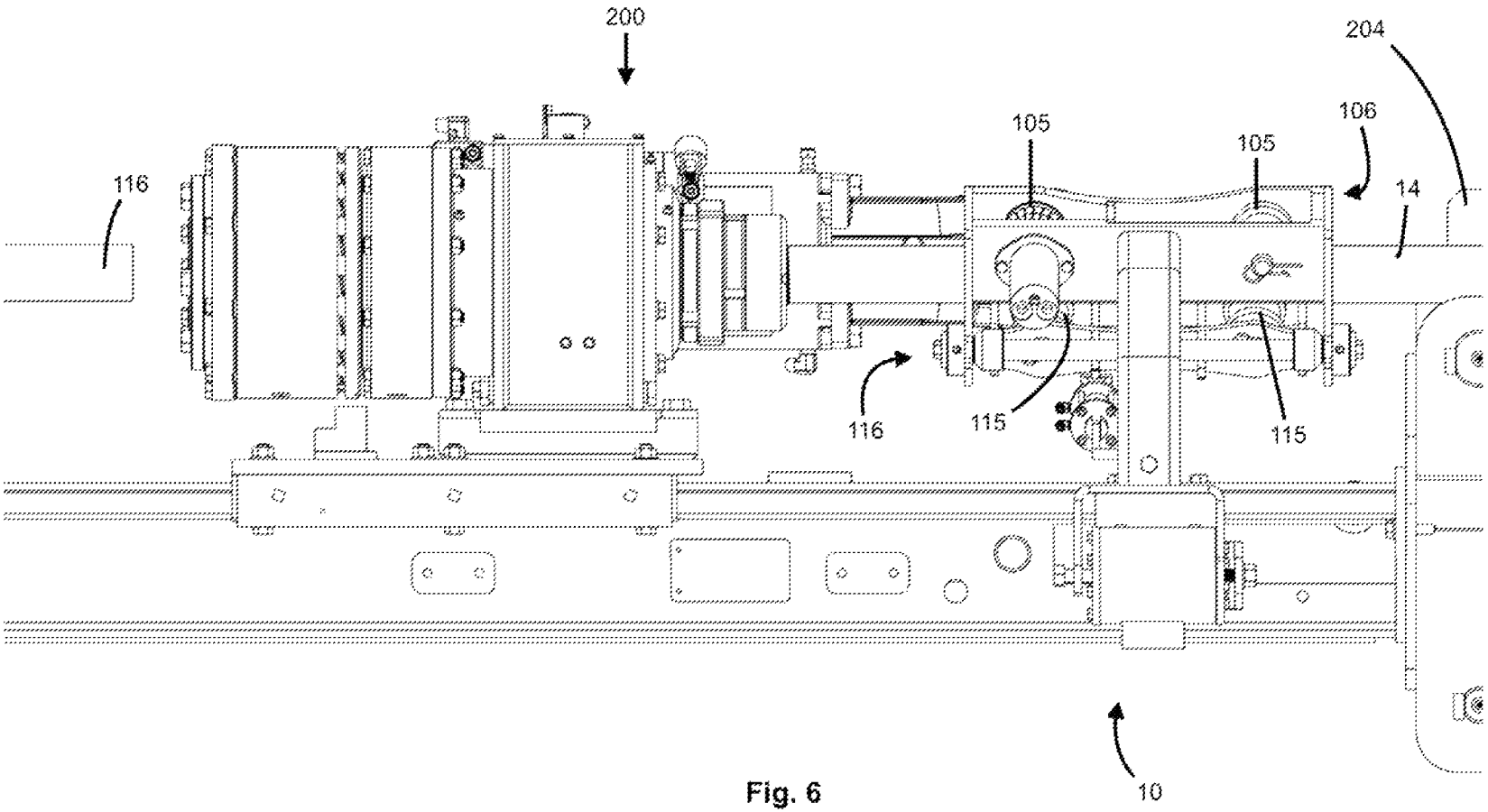
FIGS. 6 and 7 are side elevation view of the rod positioning device of FIGS. 2 to 5 during the process of aligning the drilling rod to a rod string.
Figure 7:
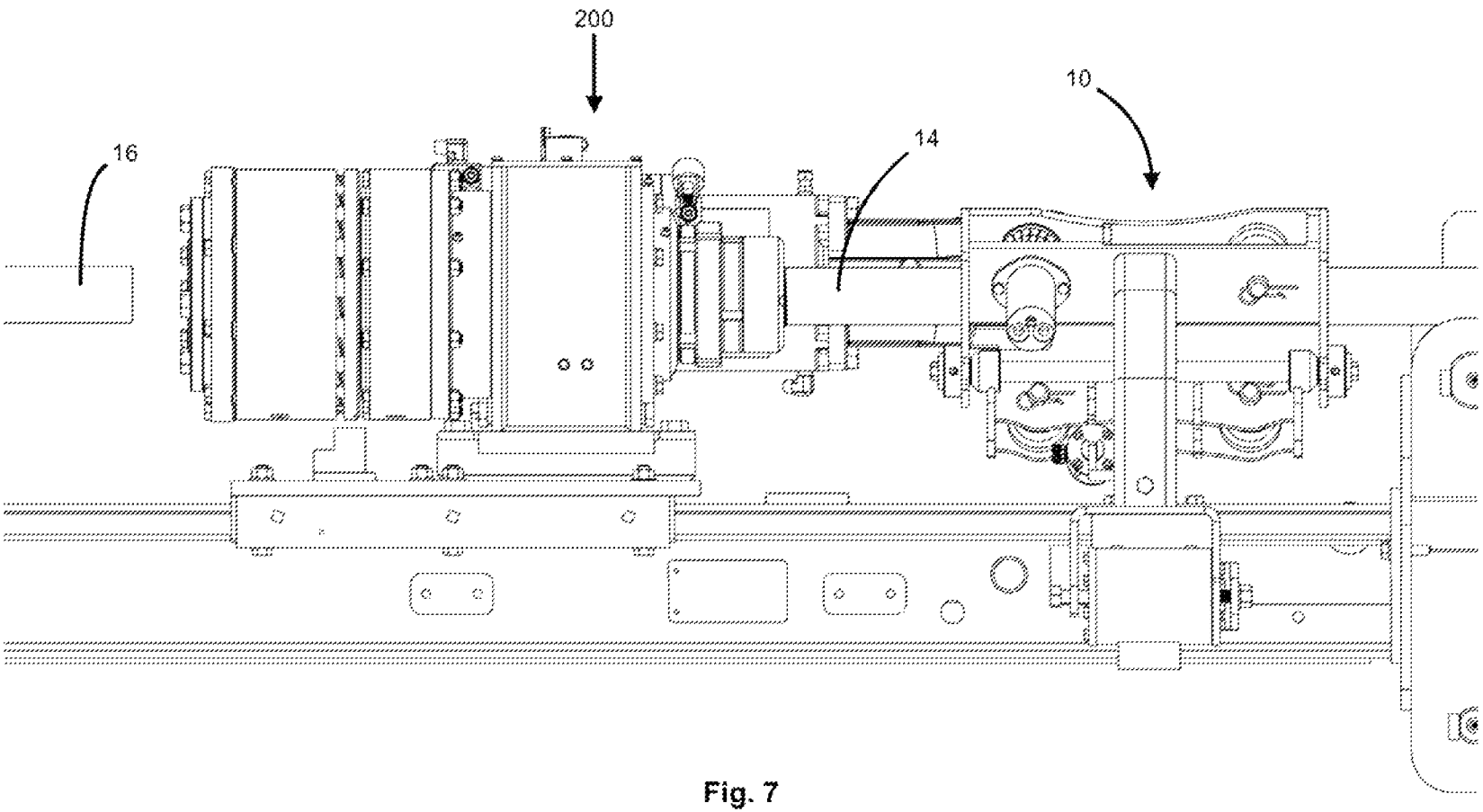
Figure 8:
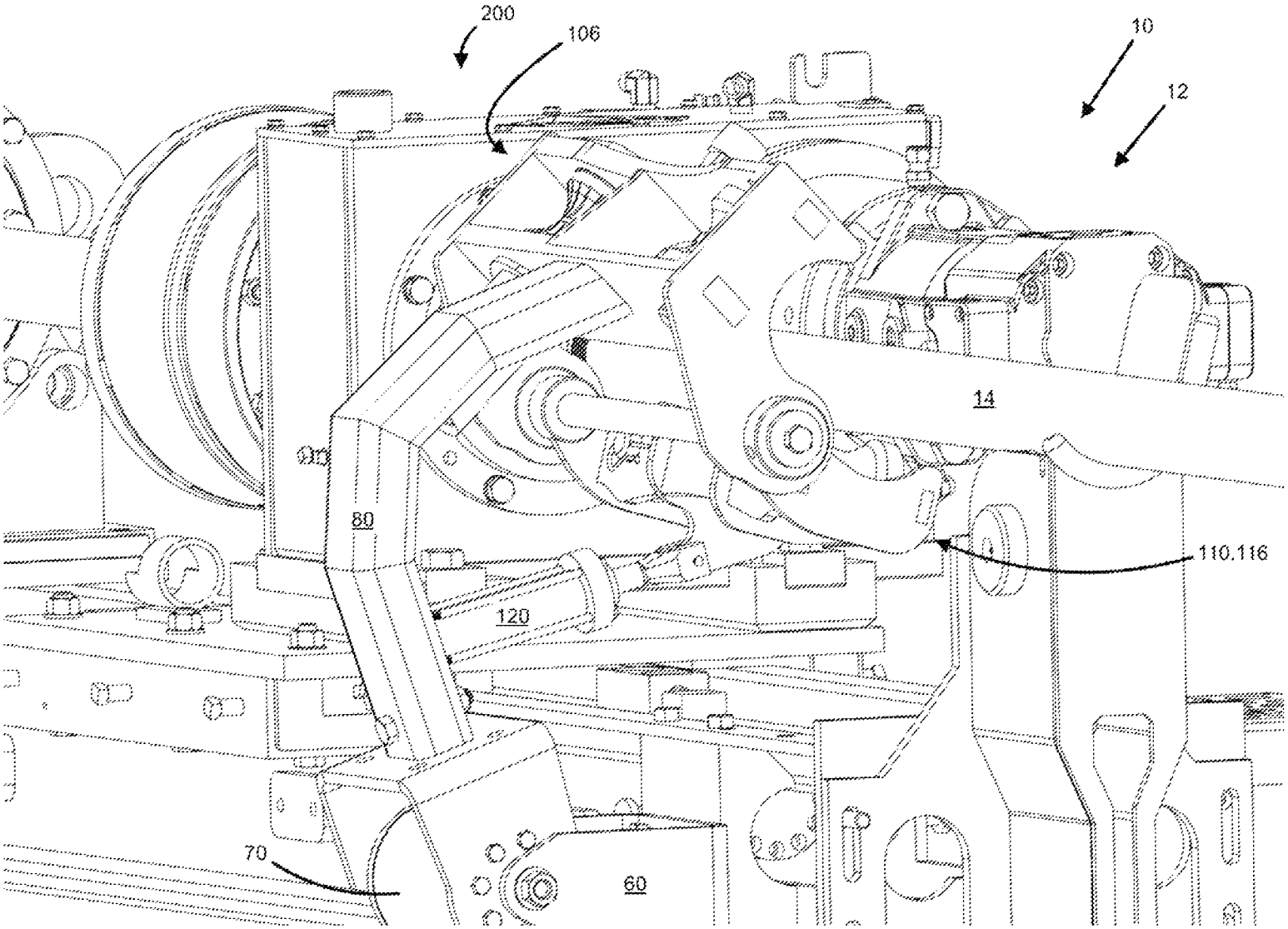
FIG. 8 is a close up partial perspective view of the rod positioning device of FIGS. 2 to 7 after the process of releasing the drilling rod.

Mounted to the second arm portion 80 at a first end 92, the still jaw arm 90 has a curved shape and a length designed to operate the rod-gripping device 12 of the rod positioning device 10 between a rod-gripping configuration (illustrated on FIG. 1) and a rod-releasing configuration (illustrated on FIGS. 6 to 8). The curved shape of the still jaw arm 90 permits to move from the rod-gripping configuration to the rod-releasing configuration without interfering with the structure of the rod string handler 200; the still jaw arm 90 pivoting about the first rotation axis 72 resulting in its rod handling portion extending substantially vertically close to the side of the rod string handler 200 and having a portion of the still jaw arm 90 after the curved portion of the still jaw arm 90 extending horizontally over a flat portion of the rod string handler 200 wherein the drilling rod 14, as further explained below, would be held in the rod-gripping device 12 of the rod positioning device 10 to be aligned with an in-use drilling rod 16. At its second end 94, the still jaw arm 90 is therefore attached (fastened or welded) to the still jaw portion 100.

Mounted to the second end 94 of still jaw arm 90, the still jaw portion 100 comprises an interior plate 101, an exterior plate 102, a left side plate 103 and a right side plate 104. The still jaw portion 100 is attached (fastened or welded) to the still jaw arm 90 through the interior plate 101. The plates 101, 102, 103, and 104 are attached together to form a rigid still jaw structure 106 capable of supporting the weight of a drilling rod 14 in rod loading position, a rod alignment position, and in positions in-between.

The still jaw structure 106 features two cylindrical still jaw guiding elements 105. The still jaw guiding elements 105 are designed to hold the drilling rod 14. The curved surface of the still jaw guiding elements 105 provides a suitable surface for the drilling rod 14 to be gripped where the drilling rod 14 is in an horizontal position and the second arm portion 80 in the rod loading position. The curved surface of the still jaw guiding elements 105 further provides a suitable surface for aligning the drilling rod 14.

According to an embodiment, the still jaw guiding elements 105 are rollers mounted on pivotal roller axes 108 joining the interior plate 101 with the exterior plate 102. The pivotal roller axes 108 are substantially perpendicular to the gripping axis 109, the longitudinal axis of a drilling rod 14 gripped by the rod gripping device 12. The rollers are configured to hold the drilling rod 14 and to rotate freely, providing liberty of movement or displacement to the drilling rod 14 about its longitudinal axis.

It is to be noted that the left side plate 103 and the right side plate 104 have a J-shaped (concave) top edge providing the necessary clearance for the drilling rod 14, when in place in the rod-gripping device 12 and supported by the still jaw guiding elements 105, to be contact-free with respect to the interior plate 101 and the exterior plate 102.

Pivotally mounted to the still jaw portion 100 about a gripping axis 121 is the mobile jaw portion 110. The mobile jaw portion 110 is pivotally attached to the still jaw structure 106 close to the top ends 107 of the left side plate 103 and right side plate 104. The mobile jaw portion 110 and the still jaw portion 100 pivot about the gripping axis 121 through which a rotation axis may be drawn. The mobile jaw portion 110 comprises a mobile jaw lug 118 extending in the direction of the joint between the second arm portion 80 and the still jaw arm 90, and more precisely in the direction of the second arm lug 86. The hydraulic power jack 120 is attached to the lugs 86, 118, controlling the operation of the combined jaws 100, 110 between an open position and a closed position as the hydraulic power jack 120 is driven between a compressed configuration and an extended configuration. The hydraulic power jack 120 is fed with hydraulic fluid by a motor (not shown) mounted on the rod string handler 200 through hydraulic hoses (not shown).

The mobile jaw portion 110, as the still jaw portion 100, features an interior plate 111, an exterior plate 112, a left side plate 113 and a right side plate 114 defining together a mobile jaw structure 116 on which are mounted a couple of cylindrical jaw guiding elements 115 having a concave shape. The mobile jaw guiding elements 115, in complement to the still jaw guiding elements 105, cooperate with the latter in aligning the drilling rod 14 within the rod-gripping device 12 of the rod positioning device 10 when the drilling rod 14 is in a rod alignment position. They are also configured to contact with and, at least in part, support the weight of the drilling rod 14 when operating the rod-gripping device 12 from the rod-gripping configuration to the rod-releasing configuration. With the drilling rod in the rod loading position, the mobile jaw portion 110 simply performs an alignment function complementarily to the still jaw portion 100. However, when the drilling rod 14 is in the alignment position, the mobile jaw portion 110 is on the bottom side of the rod-gripping device 12 and finds itself performing a rod supporting function alone. The mobile jaw portion 110 becomes positioned under the drilling rod 14 while the still jaw portion 100 ends up on top of the drilling rod 14 thereby the mobile jaw portion 110 performing solely an alignment function of the drilling rod 14. Thus, the four jaw guiding elements 105, 115 contact opposed points of the exterior face of the drilling rod 14 and distant from each other along the gripping axis 109 of the gripped drilling rod 14 are complements in performing the alignment function.

According to an embodiment, the still jaw guiding elements 105 are rollers mounted on pivotal roller axes 108 joining the interior plate 111 with the exterior plate 112. The pivotal roller axes 108 are substantially perpendicular to the gripping axis 109 of a drilling rod 14 gripped by the rod gripping device 12. The rollers are configured to hold the drilling rod 14 and to rotate freely, providing liberty of movement to the drilling rod 14 about its longitudinal axis.

It is to be noted that the left side plate 113 and the right side plate 114 of the mobile jaw portion 110 also feature a concave interior edge so as to provide the necessary clearance for the drilling rod 14 to enter solely in contact with the mobile jaw guiding elements 115 and still jaw guiding elements 105 when in the jaws are in a closed position.

FIGS. 2 to 8 illustrate step by step the process of receiving, gripping, handling, aligning and joining a drilling rod 14 with an in-use drilling rod 16. It further presents the step of releasing the drilling rod 14 joined to the in-use drilling rod 16, and thus part at this time of the rod string, from the grip of the rod positioning device 10.

Figure 2:
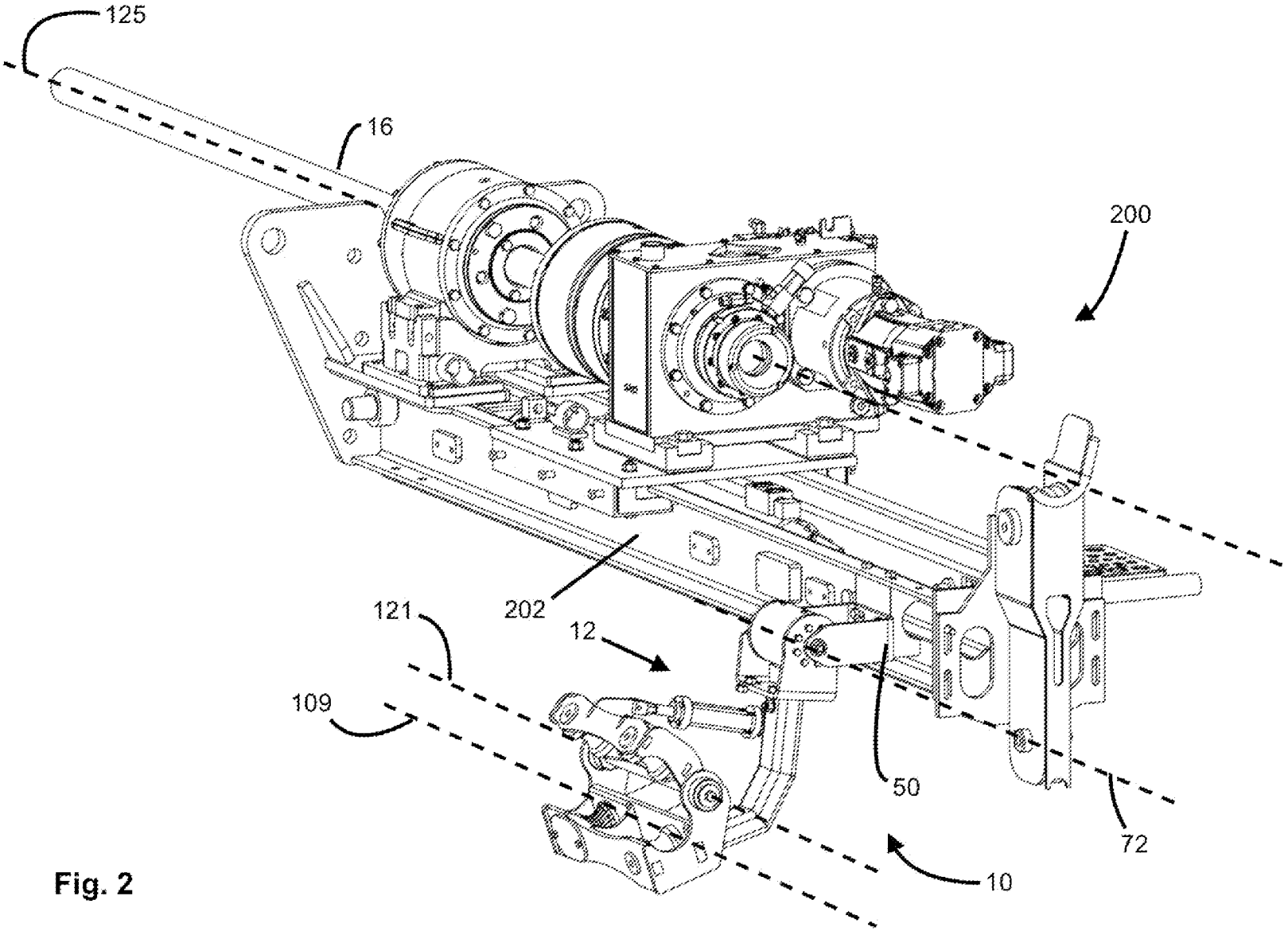
FIG. 2 is perspective view of a rod positioning device holding a drilling rod and mounted on a rod string handler in accordance with another embodiment.

Now referring more particularly to FIG. 2, there is illustrated the rod positioning device 10 mounted on the rod string handler 200, with only a portion of the rod string handler 200 visible. As shown, the base 50 is attached to a mast 202 of the rod string handler 200 (or to any other part that permits eventual alignment of the rod with the rod string). More precisely, the rod positioning device 10 is mounted on the rod string handler 200 with the first rotation axis 72 and the gripping axis 121 of the jaw joint being parallel to the string axis 125 of the in-use drilling rod 16 part of a rod string. In the illustration, the rod positioning device 10 features the arm in a rod loading position with the jaws in an open position ready to receive a drilling rod 14.

Figure 3:
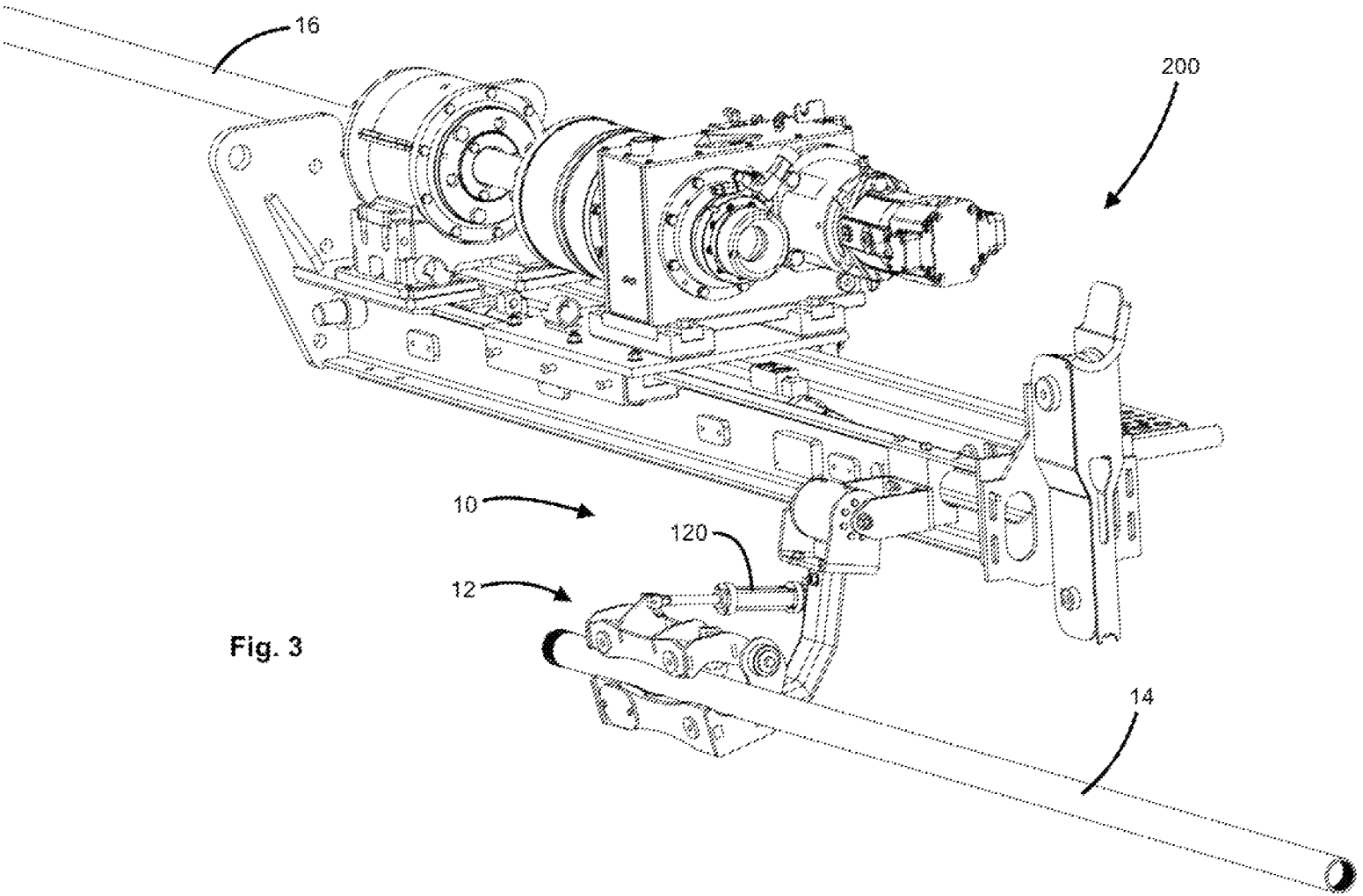
FIGS. 3 to 5 are a perspective view of the rod positioning device of FIG. 2 according to different stages during operation, comprising gripping a drilling rod and moving the drilling rod toward alignment.

FIG. 3 illustrates the rod positioning device 10 when a drilling rod 14 has been received which, in practice, sometimes consists in an operator manually carrying the drill rod 14 from a transport carrier to the jaws of the rod-gripping device 12. In order to immobilize and hold the drilling rod 14, the rod-gripping device 12 is operated for the jaws to be closer, or in other words rotated relatively to each other toward closing the space therebetween. It is to be noted that the hydraulic power jack 120 is illustrated extended, thus having the arm in a rod loading position.

Figure 4:
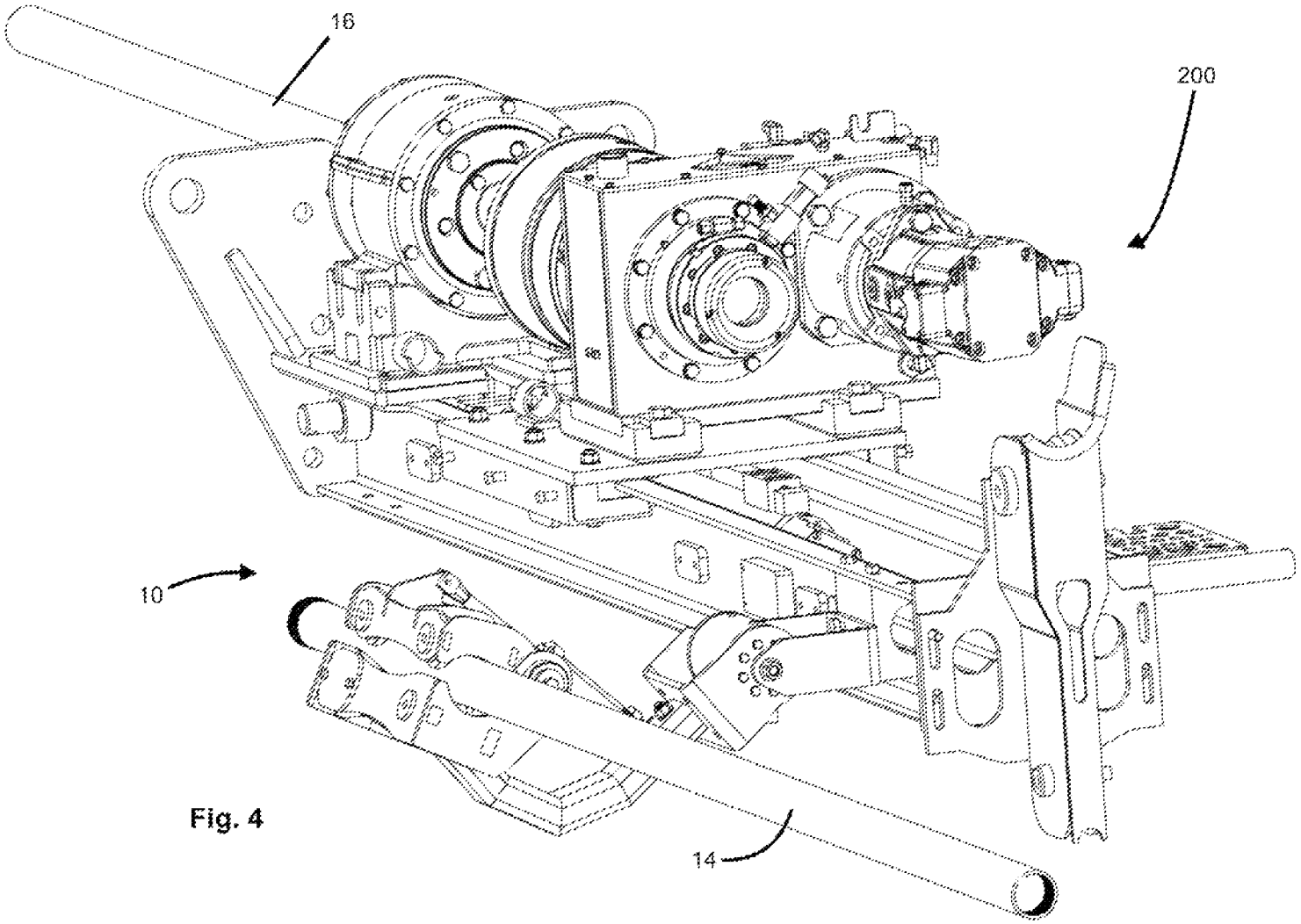

FIG. 4 illustrates the rod positioning device 10 in mid-course between the drilling rod at the loading position and the drilling rod at the alignment position. It must be noted that the still jaw guiding elements and the mobile jaw guiding elements are the ones supporting the weight of the gripped drilling rod 14 at this stage. The plates 103, 104, 113, 114 (FIG. 1) offer the necessary clearance so that the gripped drilling rod is contacting only the guiding elements. It is further to be noted that the still jaw guiding elements 105 (FIG. 1) and the mobile jaw guiding elements 115 (FIG. 1) are, in collaboration, gripping and orienting the drilling rod 14 at this stage in an orientation parallel to the longitudinal axis of the in-use drilling rod 16.

Figure 5:
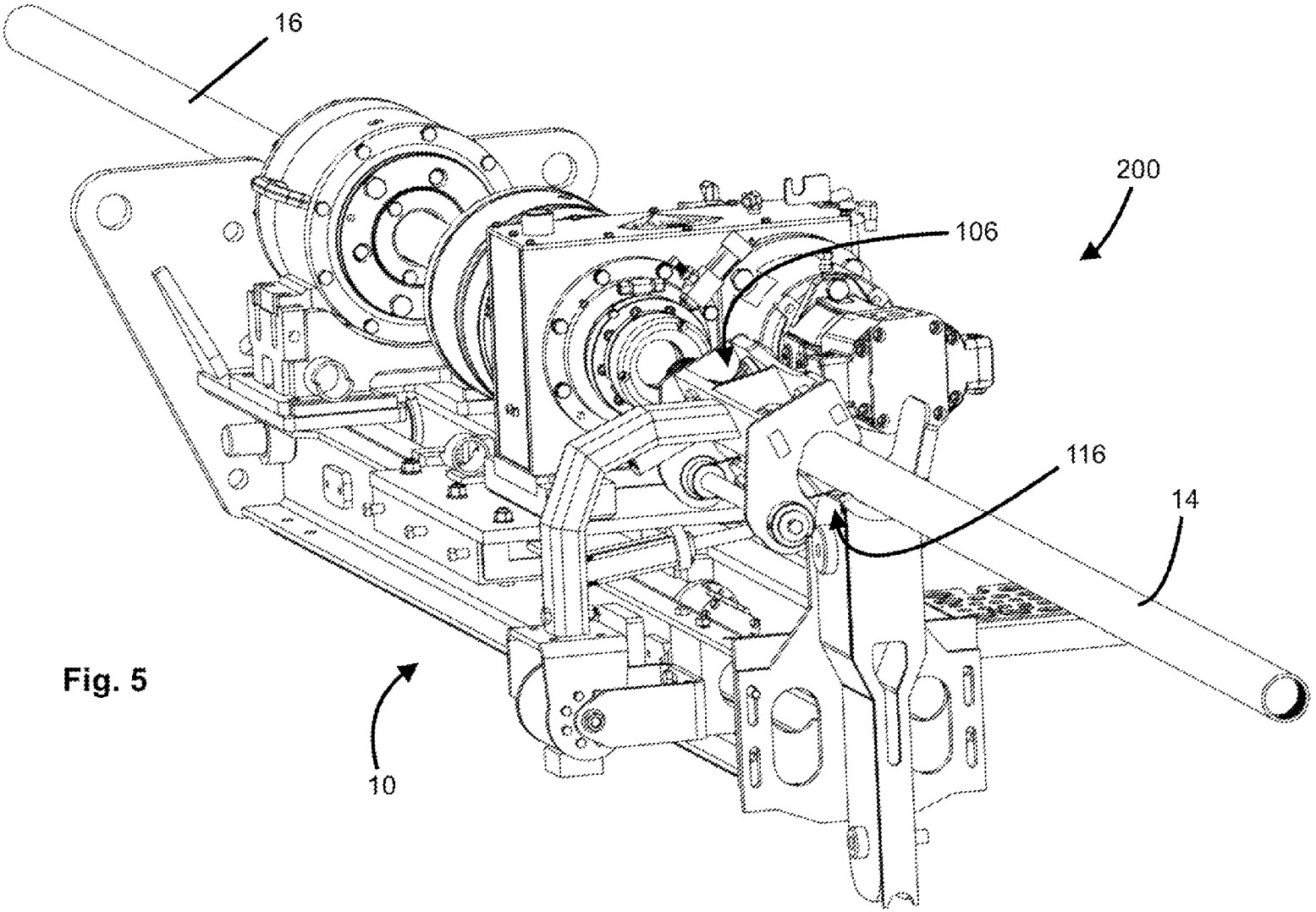

FIG. 5 illustrates the drilling rod in the rod alignment position with the still jaw structure 106 located substantially on top of the drilling rod 14 and the mobile jaw structure 116 located substantially under the drilling rod 14. That stage consists in a fine positioning of the drilling rod 14 substantially aligned to the in-use drilling rod 16. It is to be noted that at this stage the rod-gripping device 12 remains closed.

FIG. 6 illustrates the rod positioning device 10 at the beginning on the joining process of the drilling rod 14 to the in-use drilling rod 16. A pushing component 204 illustrated on the right of the drilling rod 14 pushes the drilling rod 14 towards the in-use drilling rod 16; or alternatively applies a longitudinal force of another nature over the drilling rod 14 towards the rod string. Since the still jaw guiding elements 105 and the mobile jaw guiding elements 115 provide negligible to no resistance to movement of the drilling rod 14 along its longitudinal axis, only a small force is necessary to move the still gripped drilling rod 14 closer to the in-use drilling rod 16. Thus, the rod-gripping device 12, still in the rod-releasing configuration, may maintain alignment of the gripped drilling rod 14 with the in-use drilling rod 16 during the whole junction process.

FIG. 7 illustrates the drilling rod 14 being moved along its longitudinal axis close to the in-use drilling rod 16, ready to be joined to the in-use drilling rod 16.

FIG. 8 illustrates the drilling rod 14 being freed from the rod-gripping device 12. In order to free the drilling rod 14, the hydraulic power jack 120 is compressed to move away the mobile jaw portion 110 from the drilling rod 14. Afterwards, the hydraulic rotary cylinder 70 may operate a rotation in a counter clockwise direction of the second arm portion 80 with respect to the first arm portion 60, resulting in the still jaw structure 106 moving away from the drilling rod 14 without interfering with the newly-joined drilling rod. Afterwards, in order for the rod positioning device 10 to return to the loading position illustrated on FIG. 1, the hydraulic rotary cylinder 70 continues its rotation in a counter clockwise direction until the jaw of the rod positioning device 10 reaches the rod loading position.

FIGS. 9 to 16 illustrate another embodiment of a rod positioning device 310 for aligning a drilling rod 14 with an in-use drilling rod 16 part of rod string, and further joining the drilling rod with the rod string through complementary mating threads.

Figure 9:
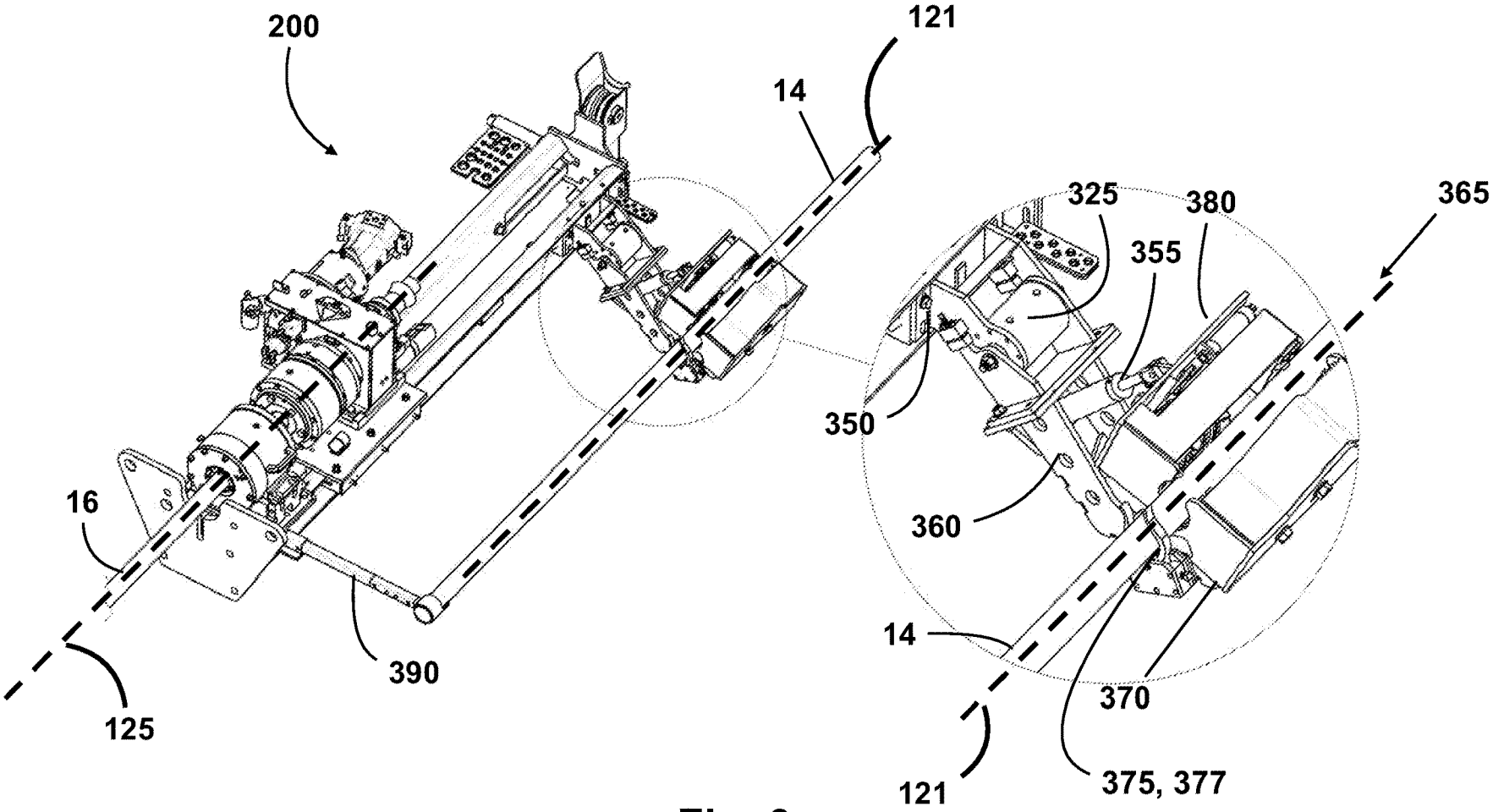
FIG. 9 is a perspective view of another of a rod positioning device according to another embodiment.

Referring to FIG. 9. the rod positioning device 310 comprises a base 350, an arm 360 pivotally attached to the base 350, a jaw assembly 365 comprising a first jaw portion 370 and a second jaw portion 380 pivotally attached to each other. The rod positioning device 310 also comprises a hydraulic rotary cylinder 325 controlling the positions of the arm 360 between rod loading position and a rod alignment position, and a hydraulic power jack 355 controlling the position of the jaw assembly 365 between an open position and a closed position. The rod positioning device 310 may further comprise a rod support 390, static component attached to the rod string handler 200 to help positioning and supporting a drilling rod 14 to be placed between the jaws 370, 380 of a rod positioning device 310. The rod positioning device 310 may further comprise a rod holding component 375 biased in a semi-closed configuration, comprising an arched member 377 bendable in a more open configuration to allow the drilling rod 14 to be pushed within the arched member 377, maintaining a portion of the drilling rod 14 in place before the jaw assembly 365 moves in an closed position. According to embodiments, one or two rod holding components 375 may be present, on the interior side of the jaws 370, 380, the exterior side of the jaws 370, 380 and on both sides of the jaws 370, 380. According to an embodiment, the rod holding component(s) 375 are mounted on the arm 360.

Figure 10:
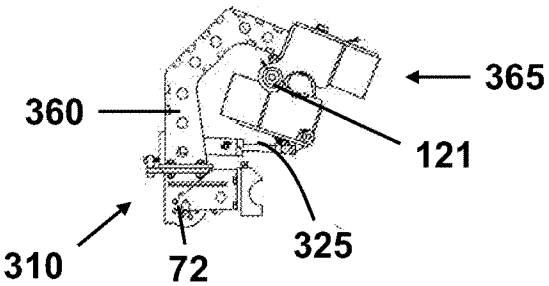
FIG. 10 is a side view of the rod positioning device of FIG. 9.

Referring to FIG. 10, there is shown a side view of the rod positioning device 310, showing the first rotation axis 72 of the rotary cylinder 325 and the gripping axis 121 of the jaw assembly 365. One must note that the first rotation axis 72, the gripping axis 121 and the longitudinal string axis 125 of the in-use drilling rod 16 (see FIG. 9) are intended to be parallel to each other with the present embodiment.

Still referring to FIG. 10, one must also note that the arm 360 has a curved shape, providing clearance in the direction of the jaw assembly 365. The jaw assembly 365 is therefore able to travel over components of the rod string handler 200 and to attach the hydraulic power jack 355 to the arm 360 at one end and to the second jaw portion 380 at the other end.

FIGS. 11*a* to 11*f* provide a plurality of views of the jaw assembly 365.

Figure 11E:
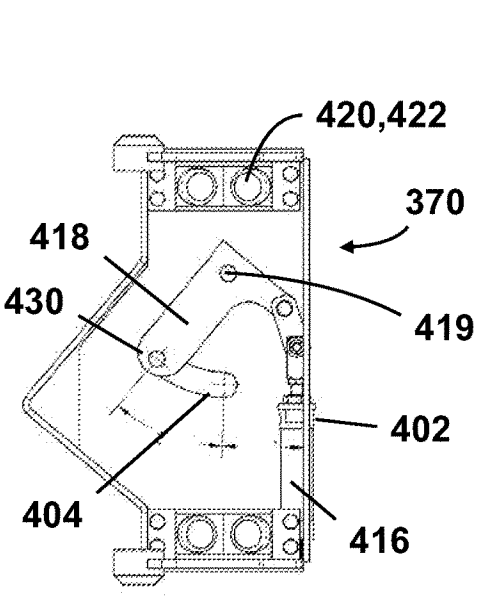
FIGS. 11*a* to 11*f* are top views and side views of the first jaw portion (FIGS. 11*a*, 11*d*, 11*e* and 11*f*) and the second jaw portion (FIGS. 11*b* and 11*c*) of the rod positioning device of FIGS. 9 and 10.
Figure 11D:
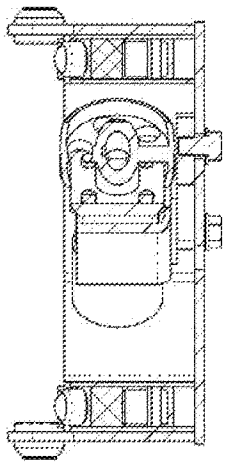
Figure 11A:
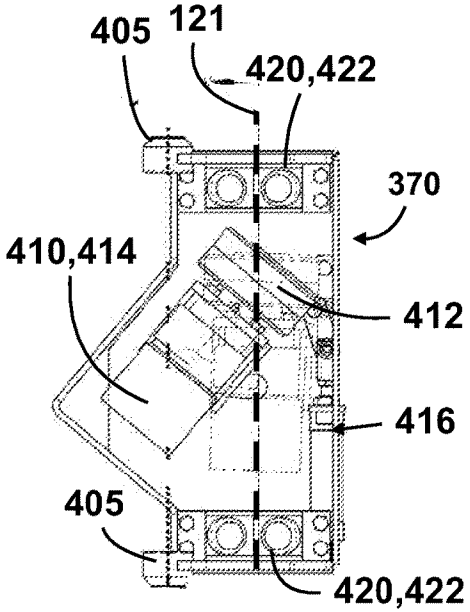
Figure 11B:
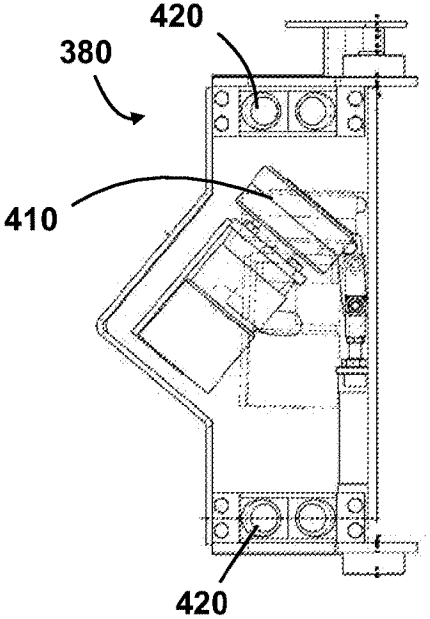

FIG. 11*a* shows an top view of the first jaw portion 370 and FIG. 11*b* shows a top view of the second jaw portion 380 featuring similar components. FIG. 11*a* shows the components facing a gripped drilling rod 14. The first jaw portion 370 comprises a housing 402 comprising junction elements 405 for pivotally joining the first jaw portion 370 with the second jaw portion 380. Distant to each other with respect to the gripping axis 121, guiding elements 420 are mounted to the housing 402, extending above the housing towards the second jaw portion 380 for having a gripped drilling rod not contacting the side of the housing 402. The guiding elements 420 each comprises two multi-directional bearings 422, and more specifically drop-in cast ball bearings, capable of accommodating rotational movement and longitudinal movement of a gripped drilling rod 14 with low resistance.

While not specifically shown, the second jaw portion 380 features a similar configuration of multi-directional guiding elements. That configuration provides strength and capability for precise alignment.

Back to FIGS. 11*a* and 11*b*, the first jaw portion comprises a rod driving element 410 capable of transferring movement to a gripped drilling rod. The rod driving element 410 comprises a hydraulic motor 414 powering a rod driving wheel 412 contacting a gripped drilling rod and, transferring movement to the gripped drilling rod. The rod driving wheel 412 is disposed at an acute angle relative to the gripping axis 121, thereby transferring both a rotational movement and a longitudinal movement to a gripped drilling rod; the ratio of rotational movement versus longitudinal movement, thus the pitch, depends on the angle. The rod driving element 410 further comprises a pitch jack 416 acting as a pitch controlling device controlling the angle of the rod driving wheel 412 to set to set the acute angle between a first angle and a second angle (the second angle being distinct and different from the first angle).

FIG. 11*b* shows similar components of the second jaw portion 380 for contacting the drilling rod held in the jaw assembly 365 on substantially opposite points of the circumference of the drilling rod contacted by the first jaw portion 370, namely a series of guiding elements 420 and a rod driving element 410. The rod driving element 410 of the second jaw portion 380 is mounted similarly to the rod driving element 410 of the first jaw portion 370; mounted to components driving the rod driving element 410 and controlling the acute angle of the rod driving element 410 relative to the longitudinal axis.

FIG. 11*e* shows the housing 402 without the hydraulic motor 414 and the rod driving wheel 412. The housing 402 features a curved slot 404. The rod driving element 410 comprises a support 418, on which is mounted the assembly comprising the hydraulic motor 414 and rod driving wheel 412, pivotally mounted to the housing about the pitch pivot axis 419. A guiding bolt 430 passing through the curved slot 404 guides at one end the movement of the support 418 while the pitch jack 416, attached at a distance from the pitch pivot axis 419, controls the angle of the support 418 and therefore the pitch of the rod driving wheel 412.

Figure 11F:
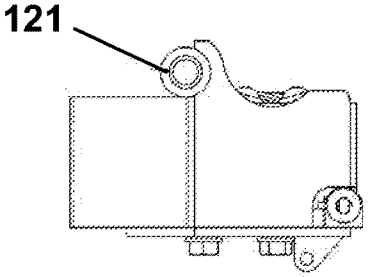
Figure 11C:
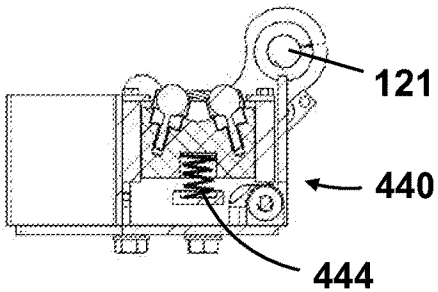

FIGS. 11*c* and 11*f* shows the housing 402 providing clearance to prevent contact between a gripped drilling rod and the housing 402, the guiding elements 420 extending over the clearance limit of the housing 402.

FIG. 11*c* shows the contact-securing assembly 440. The contact-securing assembly 440 comprises the guiding elements 420 mounted on a mounting component 442 itself mounted on a spring 444 pushing the mounting component 442 and thus the guiding elements 420 toward a gripped drilling rod and assuring permanent contact between the guiding elements 420 and the drilling rod regardless of movement and unevenness on the surface of the drilling rod.

According to alternative embodiments, based on design requirements, the hydraulic power jack 355 may be attached at one end to the arm 360 at different distance from the base 350. The hydraulic power jaw may be attached close to the jaw assembly 365, or attached at its extremities to the jaw portions 370, 380, with at least one of the jaw portions 370, 380 featuring an extension in the direction of the arm 360 to provide a lever arm for the hydraulic power jack 355 to rotate the jaw portions 270, 380 relatively to each other. According to another embodiment (not shown), the function of the hydraulic power jack 355 is alternatively performed by a rotary cylinder mounted on one of the junctions of the jaw portions 370, 380 and rotating the jaw portions 370, 380 relatively to each other.

FIGS. 12 to 15 show steps performed from the handling of the drilling rod by an operator with the jaw assembly of the rod positioning device 310 at the beginning in a rod loading position, moving and at the end returning to the rod loading position.

Figure 12:
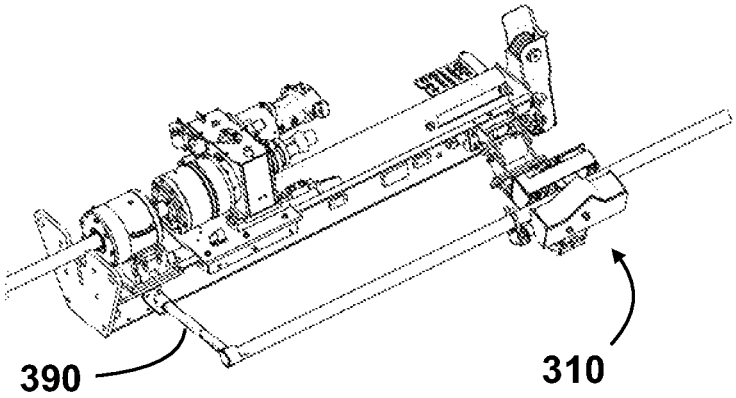
FIGS. 12 to 15 are perspective views of the rod positioning device of FIGS. 9 to 11 at different stages during a process of aligning and joining a drilling rod to a rod string.

FIG. 12 shows the rod positioning device 310 with the jaw assembly in an rod loading position, the arm lowered and the jaw assembly in an open position. The illustration shows once an operator has placed a drilling rod in the open jaw assembly, an extremity of the drilling rod supported by the rod support 390.

While not shown, the following consists in the jaw assembly in a closed position, the jaws closed over the drilling rod and the arm still down.

Figure 13:
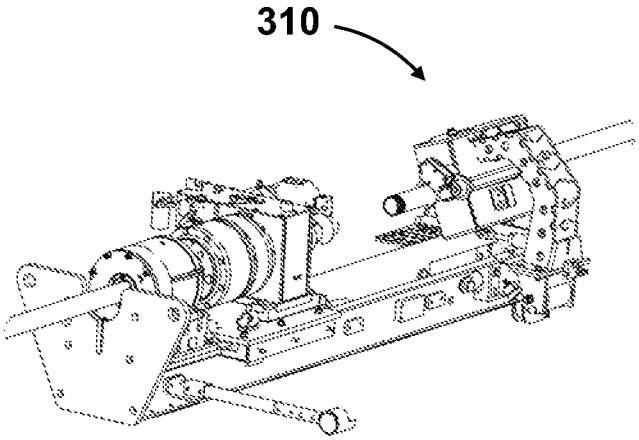

FIG. 13 shows the arm pivoted up in a rod alignment position and the rod positioning device 310 in the rod-releasing configuration. The jaw assembly is still closed.

Figure 14:
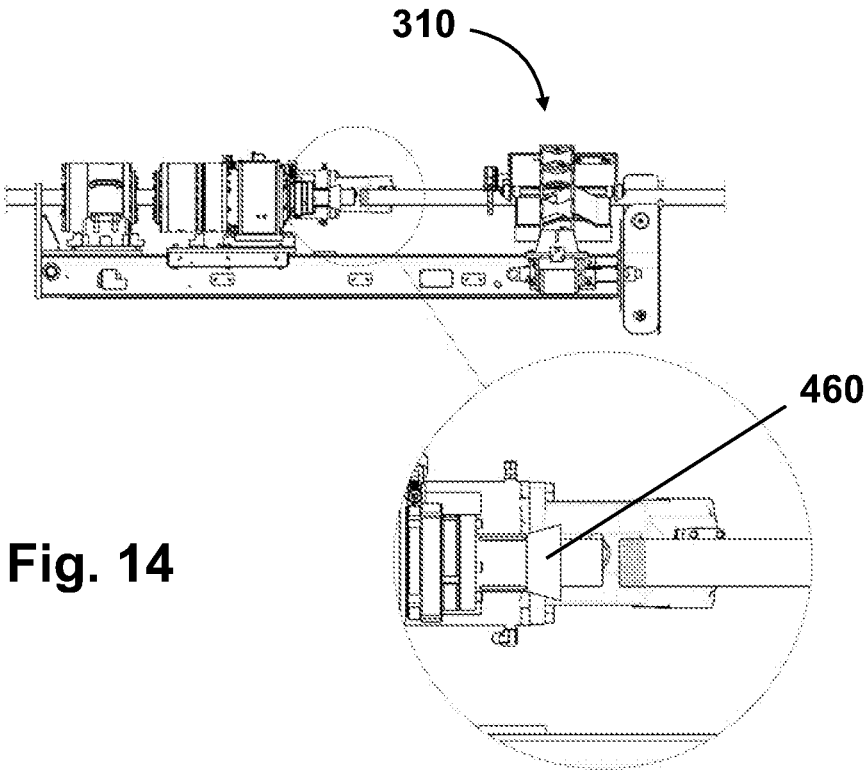

FIG. 14 shows the arm and jaw assembly still in the same position, with the drilling rod closer to the in-use drilling rod. In order to achieve that state, the hydraulic motor had to power the rod driving wheel at a first angle of a high pitch.

A closer view of the end of the drilling rod, shows the final connection of the drilling rod with the in-use drilling rod. In order to achieve the connection, the pitch jack was actuated to modify the angle of the rod driving wheel, thereby decreasing the pitch to match the pitch of the complementary threads of the to-be-joined extremities of the in-use drilling rod and of the gripped drilling rod. Additional components, such as an alignment cone 460, a detector (for example an optical distance detector), may participate in facilitating the junction of the drilling rods, and may provide information and commands for in-operation adjustments.

Figure 15:
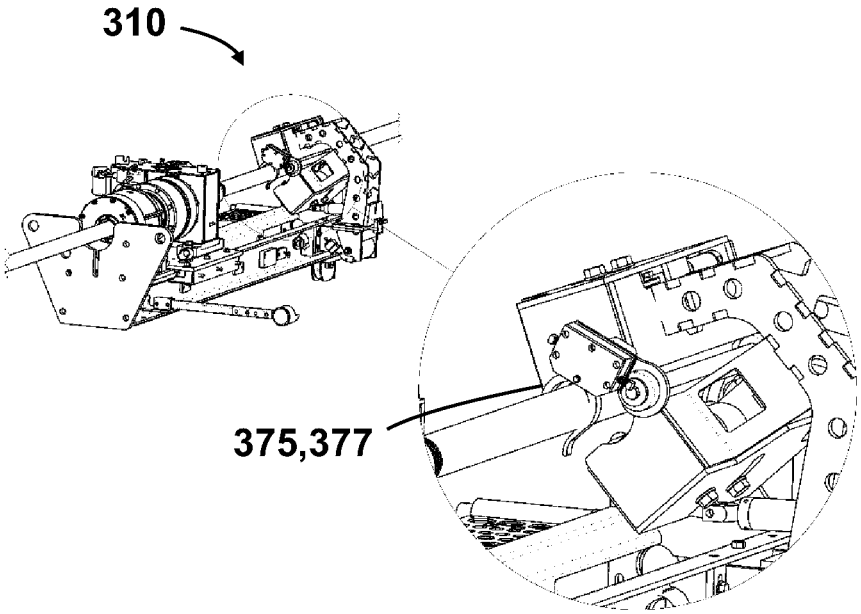

FIG. 15 shows the drilling rod part of the rod string. Once joined, the jaw assembly will open (this state being shown), the arm will rotate back from the rod alignment position to the rod loading position. Then, the arm of the rod positioning device 310 returns to its initial the rod alignment positon.

Figure 16:
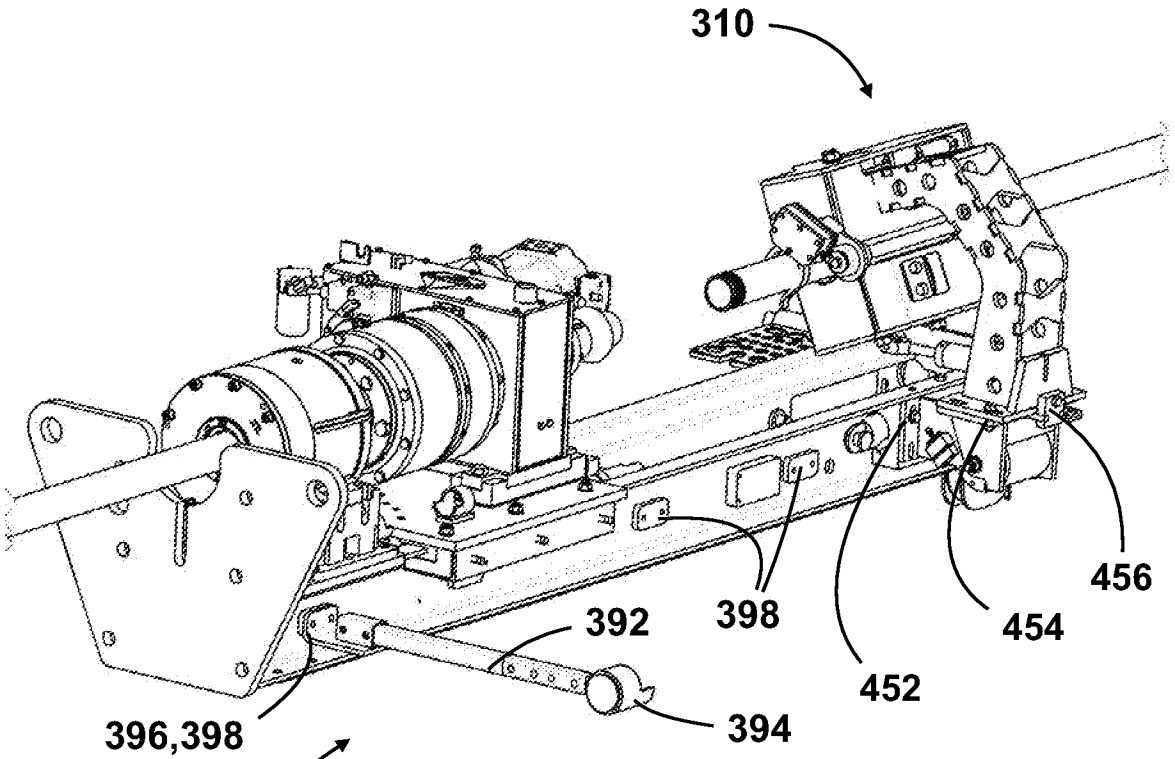
FIG. 16 is a perspective view of the rod positioning device of FIGS. 9 to 15, with specific attention to adjustment components.

FIG. 16 shows adjustment components 452, 454, 456 used during the setup configuration of the rod positioning device, more specifically for adjustment of the rotation axes parallel to the rod string longitudinal axis, and fine adjustment of the jaw assembly for a gripped drilling rod to be aligned with the string rod. Additional adjustment may comprise adjustment of the rod driving wheel angle limit to match the pitch of the mating threads.

Further, FIG. 16 shows in more detail the rod support 390 according to another embodiment. The rod support 390 comprises an extensible arm 392 comprising two arm portions sliding relative to the other and fixable with respect to the other. The rod support 390 comprises a support end 394 for holding an extremity of a drilling rod and a base end 396 to be attached to a mounting bracket 398 typically permanently attached to the mast 202 through bolts, rivets, through welding or another suitable means. A plurality of mounting brackets 398 may be attached to the mast 202 at different distance from the rod positioning device 310 for drilling rods of various lengths. The precise distance of the rod support 390 relative to the rod positioning device 310 provides a standard localisation of the extremity of the drilling rod, for programming the operation of the rod driving element 410 according to the length of the drilling rod.

Accordingly, a method of use of the rod positioning device 10 herein described includes the following steps. First, a rod is placed in the jaw portion of the rod positioning device 10, over the still jaw portion of the rod positioning device 10. Second, the second hydraulic rotary cylinder is driven in an extended configuration, thereby having the jaw portion of the rod positioning device 10 gripping the drilling rod. Third, the first hydraulic rotary cylinder is driven to rotate the jaw portion and the drilling rod in a rod alignment position wherein the drilling rod is aligned with an in-use drilling rod. Afterwards, the drilling rod gripped by the jaw portion is pushed or directed toward the in-use drilling rod. The method further comprises driving the second hydraulic rotary cylinder in a compressed configuration, freeing the driving rod from the jaw portion of the rod positioning device 10.

The method may comprise driving the first hydraulic rotary cylinder to rotate the second arm portion with respect to the first arm portion, so that the rod positioning device 10 returns in the loading position, the rod-gripping device 12 having in a rod-releasing configuration with the jaw portion in an open position ready to receive a new drilling rod. The method may comprise moving a gripped rod along its longitudinal direction to be joined to an in-use drilling rod. It may also comprise rotating the drilling rod. It may further comprise controlling the longitudinal movement versus rotation of the drilling rod, thus the pitch, to match the pitch of the threads of the in-use drilling rod. It may also comprise freeing the joined drilling rod from the grip of the rod positioning device once a drilling rod is joined.

According to the above embodiment, the guiding elements are made of material, or covered with a material, allowing longitudinal movement of the gripped drilling rod with a low force. Furthermore, the pressure applied to the jaw portions may be defined to provide the desired alignment without preventing the longitudinal movement of the gripped drilling rod.

One must note that even if the rod positioning devices of the above embodiments are driven by hydraulic power, alternative embodiments involving electrically powered components, pneumatic components or a mix of these components would be possible without departing from the scope of the disclosure.

One must further note that alternative embodiments with components located in alternative locations and/or additional components resulting in a rod positioning device performing substantially in the same manner, and featuring the same functions is also intended to be part of the scope of the disclosure.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A method of joining a drilling rod to a rod string having complementary mating threads, the method comprising:

placing the drilling rod on an arm of a rod positioning device, wherein the arm is in a rod loading position when receiving the drilling rod;

having the arm to move about a first rotation axis from the rod loading position to a rod alignment position substantially parallel to the rod loading position;

having a rod gripping device moving to a rod gripping configuration wherethrough the drilling rod becomes aligned with the rod string;

having the rod gripping device moving to a rod-releasing configuration wherein guiding elements are maintaining alignment of the drilling rod with the rod string and are enabling longitudinal displacement of the drilling rod upon application of a longitudinal force on the drilling rod to contact the rod string, whereby the drilling rod is attached to the rod string.

2. The method of claim 1, wherein the guiding elements comprise rollers pivoting about at least a roller pivotal axis perpendicular to an axis of the drilling rod.

3. The method of claim 1, further comprising applying a rotational force over the drilling rod for the mating threads of the drilling rod and the rod string to join.

4. The method of claim 1, wherein the rod positioning device comprises a jack controlling a transition between the rod-gripping configuration and the rod-releasing configuration, the jack having a first end attached to the arm and a second end attached to a pivoting jaw.

5. The method of claim 4, wherein the rod positioning device comprises a jaw opposite to the pivoting jaw that is fixedly mounted to the arm.

6. The method of claim 1, wherein the arm provides clearance between the first rotation axis and an axis of the drilling rod.

7. The method of claim 1, wherein the rod-gripping device comprises a rod driving element oriented at an acute angle relative to an axis of the drilling rod for longitudinally displacing and rotating the drilling rod to put into contact and to join the drilling rod to the rod string through the complementary mating threads.

8. A rod positioning device applying the method of claim 1.

9. A method of attaching a joining rod to a rod string having complementary mating threads, the method comprising:

placing the drilling rod on an arm of a rod positioning device;

having a rod-gripping device mounted to the arm and defining thereby a gripping axis gripping the drilling rod with guiding elements adapted for providing alignment of the drilling rod to the gripping axis, and a rod driving element oriented at an acute angle relative to the gripping axis; and powering the rod driving element thereby longitudinally displacing and rotating the drilling rod to put into contact and to join the drilling rod to the rod string through the complementary mating threads.

10. The method of claim 9, wherein the guiding elements are multi-directional low-resistance guiding elements.

11. The method of claim 9, wherein the guiding elements comprises drop-in cast ball bearings.

12. The method of claim 9, wherein the rod-gripping device comprises a first jaw and a second jaw, wherein the rod driving element is mounted to the first jaw.

13. The method of claim 12, wherein the guiding elements further comprise a mounting component mounted on the first jaw, wherein the mounting component is biased toward the second jaw.

14. The method of claim 9, wherein the rod positioning device comprises a base, wherein the arm is movably mounted to the base.

15. The method of claim 9, comprising setting the acute angle between a first angle and a second angle distinct from the first angle.

16. The method of claim 15, wherein the rod-gripping device further comprises a pitch controlling device adapted to set the acute angle between the first angle and the second angle.

17. The method of claim 9, wherein the rod driving element comprises a rod driving wheel contacting the drilling rod at the acute angle.

18. The method of claim 9, wherein the rod driving element comprises a motor mounted to the rod gripping device and a driving wheel mounted to the motor, wherein the driving wheel drives the drilling rod in a longitudinal and rotational movement according to the acute angle.

19. The method of claim 9, wherein the rod positioning device comprises a mast and a rod support, wherein the arm and the rod support are mounted to the mast distal from each other, and wherein the drilling rod is disposed on the rod support and the rod-gripping device.

20. A method of joining a drilling rod to a rod string having complementary mating threads, the method comprising:

placing the drilling rod on an arm of a rod positioning device;

using a rod-gripping device mounted to the arm, defining a gripping axis, having:

jaws having a first end and a second end relative to the gripping axis moving to a rod gripping configuration;

guiding elements mounted to the jaws distant from each other along the gripping axis contacting the drilling rod for alignment of the drilling rod with the gripping axis; and a rod driving element oriented at an acute angle relative to the string axis for longitudinally displacing and rotating the drilling rod upon actuation of the rod driving element, whereby the drilling rod is put into contact and joined to the rod string through the complementary mating threads.

* * * * *